United States Patent [19]

Kidd

[11] Patent Number: 4,850,478

[45] Date of Patent: Jul. 25, 1989

[54] NOVEL SPACE-SAVING CARRIER FOR CONTAINERS

[75] Inventor: Daniel R. Kidd, Columbus, Ohio

[73] Assignee: Nationwide Industries, Inc., Durham, N.C.

[21] Appl. No.: 161,446

[22] Filed: Feb. 18, 1988

[51] Int. Cl.[4] ..... B65D 75/00

[52] U.S. Cl. ..... 206/147; 206/145; 206/427; 206/434; 294/87.2

[58] Field of Search ..... 206/153, 154, 155, 168, 206/194, 199, 145, 147, 427, 434; 229/40, DIG. 2, DIG. 5; 294/87.2, 87.28

[56] References Cited

U.S. PATENT DOCUMENTS

| | | | |
|---|---|---|---|
| Re. 25,781 | 5/1965 | Akeireb | 206/153 |
| 3,016,259 | 1/1962 | Lawrence | 206/153 |
| 3,926,307 | 12/1965 | Klygis | 206/153 |
| 4,621,734 | 11/1986 | Heijnen et al. | 206/153 |

FOREIGN PATENT DOCUMENTS

| | | | |
|---|---|---|---|
| 1170630 | 7/1984 | Canada | 206/145 |
| 48506 | 3/1982 | European Pat. Off. | 206/145 |
| 2085391 | 4/1982 | United Kingdom | 206/145 |

*Primary Examiner*—David T. Fidei

*Attorney, Agent, or Firm*—Louis Weinstein

[57] ABSTRACT

A carrier for a plurality of narrow-neck, tapered containers is formed from a carrier blank comprises of a single sheet which is folded to define a rectangular tubular configuration, the dimensions of the carrier being such that it does not increase the volume occupied by the containers which it supports and such that the major portion of each container is exposed to view and so that the main body portion is substantially completely exposed to view. The carrier blank is provided with openings, each of which lockingly receive the neck of a container, the containers and the carrier cooperating with one another to retain the containers in the locked position relative to the carrier and the carrier being maintained in its fully erected condition. The dimensions and locations of the openings provided in the carton blank serve to releasably lock the carrier and containers to one another and further prevent the containers, when arranged in side-by-side pairs, from swinging freely, especially when being transported. The carrier is further provided with convenient finger grips to facilitate carrying and handling thereof. The carrier is characterized by its ease of assembly and ease of container insertion.

22 Claims, 5 Drawing Sheets

NOVEL SPACE-SAVING CARRIER FOR CONTAINERS

FIELD OF THE INVENTION

The present invention relates to carriers for containers and the like and more particularly to a novel, inexpensive carrier of simplified design to facilitate the storage, handling and carrying of narrow neck containers and the like without adding to the volume occupied by the containers when stored.

BACKGROUND OF THE INVENTION

It is typical to provide suitable carrying means for storage, handling and transportation of containers and the like. For example, it is advantageous to provide carriers to facilitate the handling and carrying of a plurality of individual containers and, packaging typically referred to as "six-packs" are utilized to facilitate the handling and carrying of containers from the point of view of safety and ease of handling as well as a means for encouraging sales of a plurality of such containers, the inducement to a customer being that the carrier makes it convenient to store, handle and carry a plurality of containers through the use of the carrier.

It is, however, incumbent upon the designer to provide a carrier which is inexpensive, simple in design, construction and assembly, which does not increase the volume normally occupied by such carriers and further to provide an inexpensive carrier which is simple to erect and into which the container may be releasably mounted and yet easily removed for subsequent use.

BRIEF DESCRIPTION OF THE INVENTION

The carrier of the present invention is characterized by comprising a single preferably die-cut blank or sheet, preferably of a corrugated cardboard construction which is scored in such a way as to facilitate the folding of the carrier blank into a generally tubular, rectangular configuration which is further provided with openings for releasably securing the necks of narrow-necked containers, the carrier blank being folded in such a way that it does not increase the volume occupied by the containers and exposes most of the container surface to facilitate better examination of the product by potential customers by exposing principally the aesthetically appealing portions of the container to plain view. The carrier is also provided with further openings to facilitate gripping, handling and transportation of the carrier and hence the multiple containers supported thereby. The blank is folded over to define an upper central portion, two side walls and an underside comprised of either two overlying bottom panels or flaps in the case of one preferred embodiment and two side-by-side underside or bottom flaps in the case of still another embodiment.

In all of the preferred embodiments, the neck portions of the containers extend through carrier openings to retain the carrier in the fully erected position. The top central panel is provided with an opening for each container neck. The inner diameter of each opening is less than the outer diameter of the container neck portion and cooperates with an annular groove in the neck portion, which groove is of reduced diameter to releasably lock the container to the carrier. The annular recess or groove may be provided in the neck portion or may be comprised of an annular gap or groove between the lip of the container closure cap and an adjacent shoulder on the neck portion which defines an annular groove for cooperation with an associated opening in the carrier.

In the carrier embodiment in which the containers are arranged in a plurality of side-by-side pairs, the relative positioning of the openings of the respective top and bottom panels urge the bottom panels to assume an angular orientation which enhances the structural strength of the carrier and further maintains the pairs of containers in engagement to further rigidify the package assembly and also prevents the containers from experiencing free swinging movement when being carried, for example. All of the carrier embodiments are characterized by simplicity of design, ease of assembly and use and affording the carrier/container assembly with superior rigidity and structural supporting strength and maximum exposure of the containers supported by the carrier.

OBJECTS OF THE INVENTION AND BRIEF DESCRIPTION OF THE FIGURES

It is therefore one object of the invention to provide a novel carrier for narrow-neck containers and the like for releasably supporting a plurality of such containers wherein the carrier is characterized by facilitating the convenient storage, handling and transportation of a plurality of such containers without any increase in the storage space normally occupied by the containers in the absence of the carrier.

Still another object of the present invention is to provide a carrier for a plurality of narrow-neck containers and being characterized by providing superior structural strength and support for the containers to prevent their movement during handling and to rigidify the supporting carrier, these objectives being achieved through the geometric arrangement of the carrier blank and the openings provided therein.

Still another object of the invention is to provide a carrier for supporting a plurality of containers whereby a major portion of the container is exposed to view and whereby the carrier does not increase the storage volume normally occupied by the containers.

The above, as well as other objects of the present invention will become apparent when reading the accompanying description and drawings in which:

FIG. 1*a* shows a plan view of a carrier blank of one preferred embodiment of the present invention.

FIG. 1*b* shows an end view of the carrier of FIG. 1 in the erected (folded) position.

FIG. 1*c* is a perspective view of a container for use in the carrier of FIGS. 1–1*c*.

FIGS. 2*a*, 2*b* and 2*c* respectively show end, side and top views of the embodiment of FIGS. 1*a* and 1*b* showing the containers mounted in the carrier.

FIG. 3*a* shows a plan view of a carrier blank of an alternative embodiment of the present invention.

FIGS. 3*b* through 3*d* show different views of the preferred embodiment of FIG. 3*a*.

FIGS. 4*a*–4*g* are plan views showing various container shapes which may be employed with the carrier of the present invention.

DETAILED DESCRIPTION OF THE INVENTION AND THE PREFERRED EMBODIMENTS THEREOF

Figure 1C:
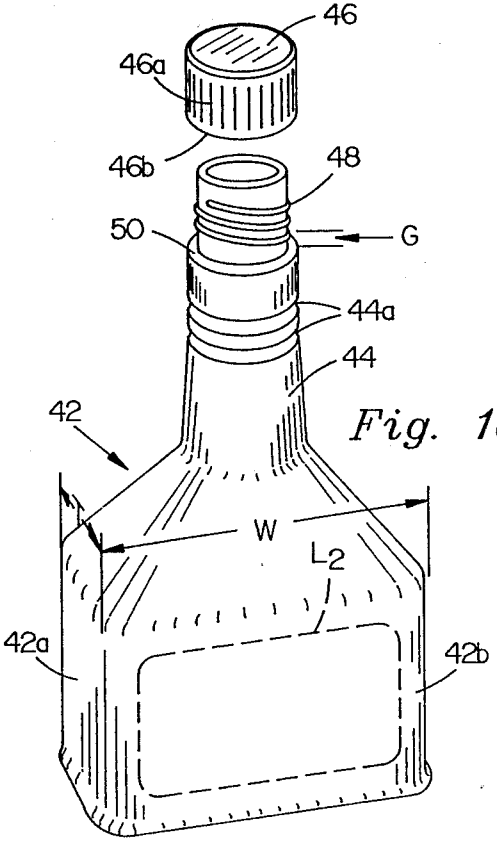
Figures 2A, 2B, 2C:
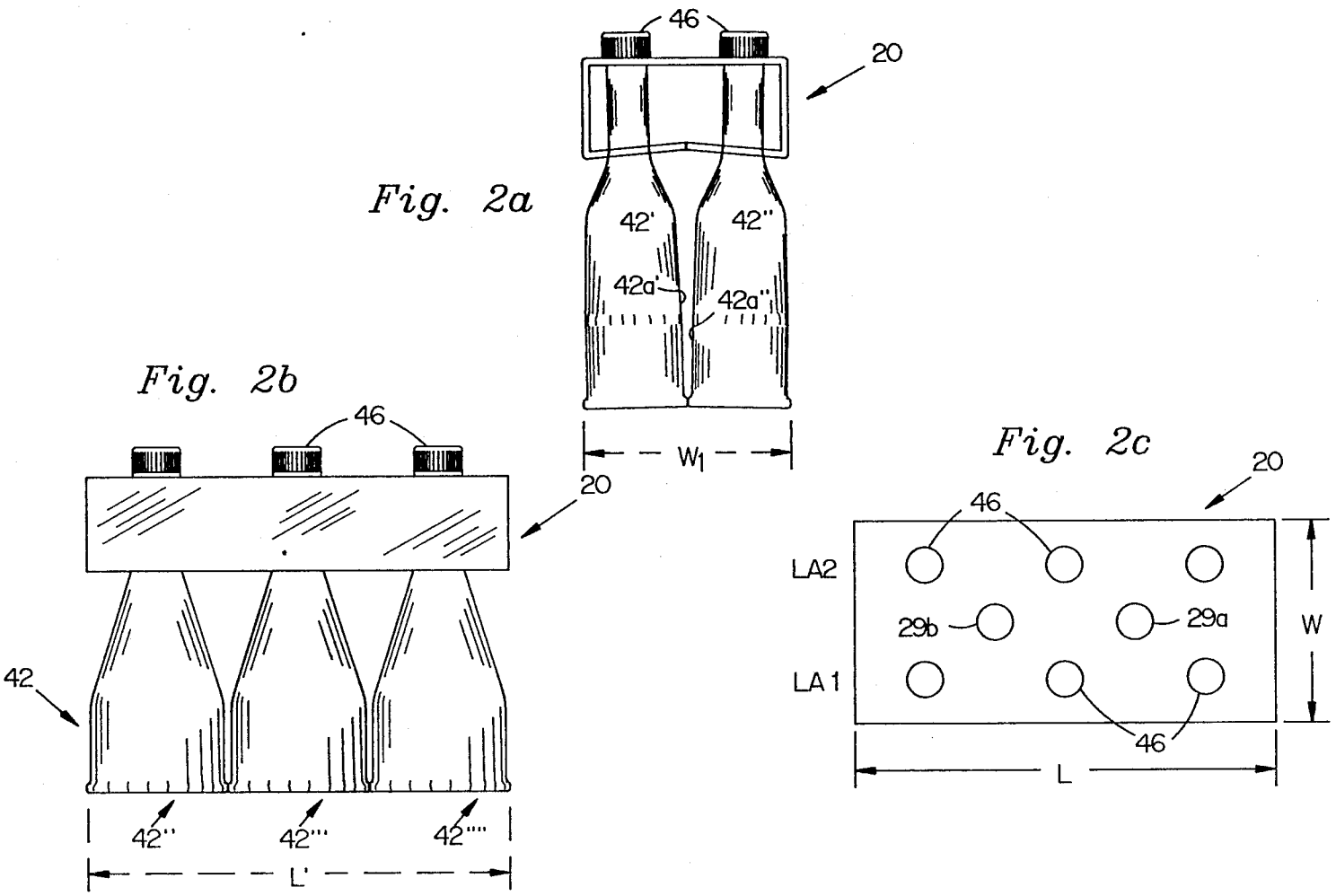

FIGS. 2*a* through 2*c* show a combined carrier and container assembly 10 comprised of a carrier 20 and a plurality of containers 40. FIG. 1*c* shows a detailed perspective view of a container. Each of the containers 40 is hollow and is preferably formed of a suitable plastic material capable of withstanding relatively rough handling and has a lower, main body portion 42 of a generally rectangular shape, the containers having a width dimension W which is substantially greater than the thickness dimension T to define a pair of long sides 42*a*, 42*a* and a pair of short sides 42*b*, 42*b*. The container has an integral, tapered, narrow-necked portion 44 with an open upper end provided with a threaded portion 48 for receiving a closure cap 46. The neck portion 44 of each container 40 is preferably provided with a larger diameter portion immediately adjacent the lower end of the threaded portion 48 to define a shoulder 50. The lip 46*b* of closure cap 46, skirt 46*a* and shoulder 50 cooperate to define an annular gap G which may be employed for interlocking the container to the carrier as will be more fully described.

The neck portion 44 may also be provided with one or more annular recesses 44*a* for interlocking use with the carrier in a manner similar to annular gap G, as will be more fully described.

Figure 1A:
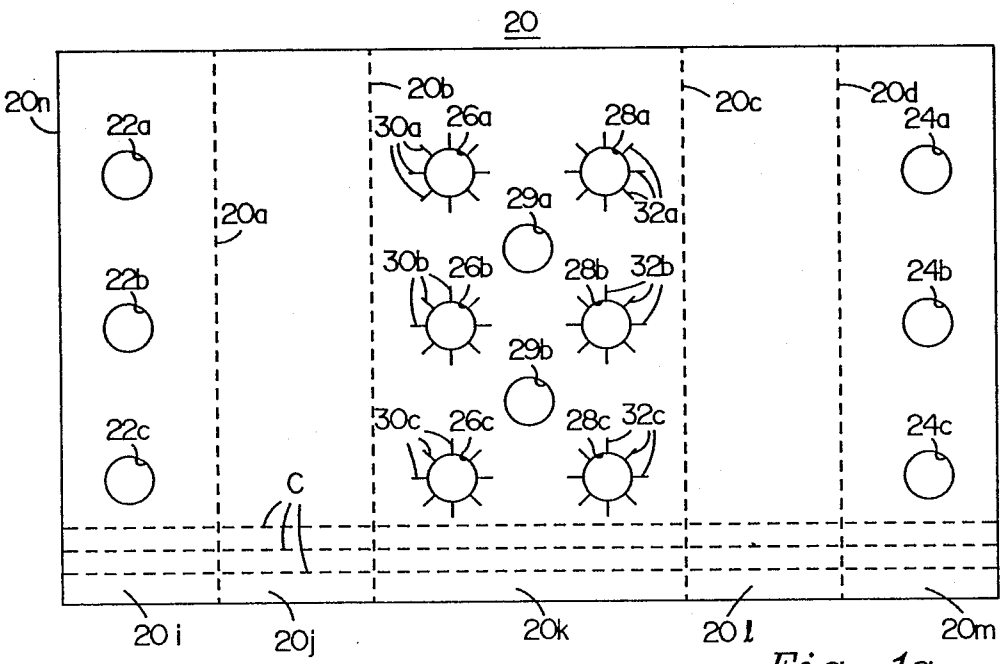
Figure 1B:
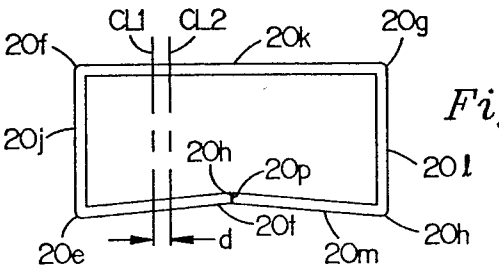

Carrier blank 20 shown in FIGS. 1*a* and 1*b* is formed of a stiff material, preferably corrugated cardboard. In one preferred embodiment, the carrier may be constructed of 200 pounds B-flute (42 pounds Kraft paper interliner, 26 Media and 42 pounds Crest White) corrugated.

The carrier blank is constructed from a substantially flat sheet shown in FIG. 1 which is preferably die cut and is scored to provide score lines arranged at a right angle relative to the running direction of the corrugations C shown by a few representative dotted lines in FIG. 1*a*.

The score lines 20*a* through 20*d* facilitate folding over of the sheet to form four corners 20*e*–20*h*, respectively. The corners, together with the solid side panels 20*j*–201 enhance the structural strength that is dynamic to the design of the present invention.

The bends or corners 20*e*–20*h* serve to define a top center panel 20*k*, two side panels 20*j*, 201 and bottom panels 20*i*, 20*m*.

Panel 20*i* is provided with a linear array of circular openings 22*a*–22*c*. Panel 20*m* is provided with a linear array of circular openings 24*a*–24*c*. Panel 20*k* is provided with a first linear array of circular openings 26*a*–26*c* which cooperate with openings 22*a*–22*c* respectively in a manner to be more fully described. Similarly, a second linear array of openings 28*a*–28*c* in panel 20*k* cooperate with openings 24*a*–24*c* in a similar manner. Openings 29*a* and 29*b* serve as means for holding and transporting the assembled carrier in a manner to be more fully described. Each linear array of openings has the centers of the array of openings lying along an imaginary straight line. The openings in each array are of substantially uniform diameter.

Openings 26*a*–26*c* are each provided with a plurality of equi-angularly spaced, radially aligned slits 30*a*–30*c* to facilitate insertion of a container neck 44 and interlocking of the carrier and container in a manner to be more fully described. Openings 28*a*–28*c* are similarly each provided with a plurality of equi-angularly spaced, radially aligned slits 32*a*–32*c* respectively.

The die cut sheet 20 is divided into five panels by the four scores 20*a*–20*d*. The sheet is bent to form the folds at 20*e*–20*h* to define a four-sided rectangular tubular structure shown, for example, in FIG. 1*b*.

The unique characteristic of carrier 20 is that it dimensionally does not increase the cubic inch or perimeter boundary of the products to be supported by the carrier, thus enabling the product to be packed in the same reshipper carton (not shown) used for bulk distribution. This feature also eliminates the handling of each individual product which is grouped in the carrier. The rigidity of the carrier, as well as the stability of the product supported by the carrier, is achieved by the size and center line locations of the die cut holes provided in the carrier for receiving the necks of the containers. More specifically, the holes 22*a*–22*c* and 24*a*–24*c* are positioned relative to the associated holes 26*a*–26*c* and 28*a*–28*c* so that the center lines of the cooperating arrays of holes, which center lines are perpendicular to the plane of FIG. 1*a*, are offset relative to one another. More particularly, center lines CL1 of openings 26*a*–26*c* are displaced from the center lines CL2 of operating openings 22*a*–22*c* by a finite distance d. The displacement distance d causes an interference between openings 22*a*–22*c* and the necks of the associated containers along the interior 180° of the adjacent bottom panels 20*i*, 20*m*. This interference fit draws the panels 20*i* and 20*m* inwardly so that their free edges 20*m* and 20*p* are in engagement and further urges the panels 20*i* and 20*m* into an angular orientation such that they are nonparallel with upper panel 20*j*, as shown best in FIG. 1*b*. The diameter of openings 22*a*–22*c* and 24*a*–24*c* is greater than the outer diameter of the portion of the container necks surrounded by these openings by an amount sufficient to enable the bottom panels 20*i*, 20*m* to assume the inverted V-shaped orientation shown in FIG. 1*b*. The result is that the carrier forces the long sides 42*a* (or at least the lower ends) of associated containers of the linear arrays into engagement. For example, considering FIG. 2*a*, the long sides 42*a*' 42*a*'' (or at least the lower ends) of containers 42', 42'' are urged into engagement with one another as opposed to being in a pendulous, or free swinging, state thereby providing the assembly comprised of the carrier and the containers with greater stability for storage, handling and transportation. The interference created between openings 22*a*–22*c*, 24*a*–24*c* and the necks 44 of the containers also acts as a secondary product load bearing feature and further provides additional supporting strength due to the non-parallel orientation of the panels 20*i* and 20*m* relative to the panel 20*j*.

Holes 26*a*–26*c* and 28*a*–28*c* comprise the primary load bearing points of carrier 20. The interference fit between the corrugated carrier sheet 20 and each container 40 is achieved by the inner diameter of the holes being preferably of the order of 8 to 12 percent and more preferably 10 percent smaller than the outer diameter of the container neck portion which it surrounds. The radially aligned slits, such as 30*a*–30*c*, for example, facilitate the ease of insertion of each container neck into associated openings 26*a*–26*c*, 28*a*–28*c* and allows the corrugations to lock in the gap G to prevent the container from dropping from the carrier device. As another alternative, the openings 26*a*–26*c* and 28*a*–28*c* may be arranged within one of the grooves 44*a* provided on the neck 44 of the container, preferably in the region of the gap G.

Figure 3A:
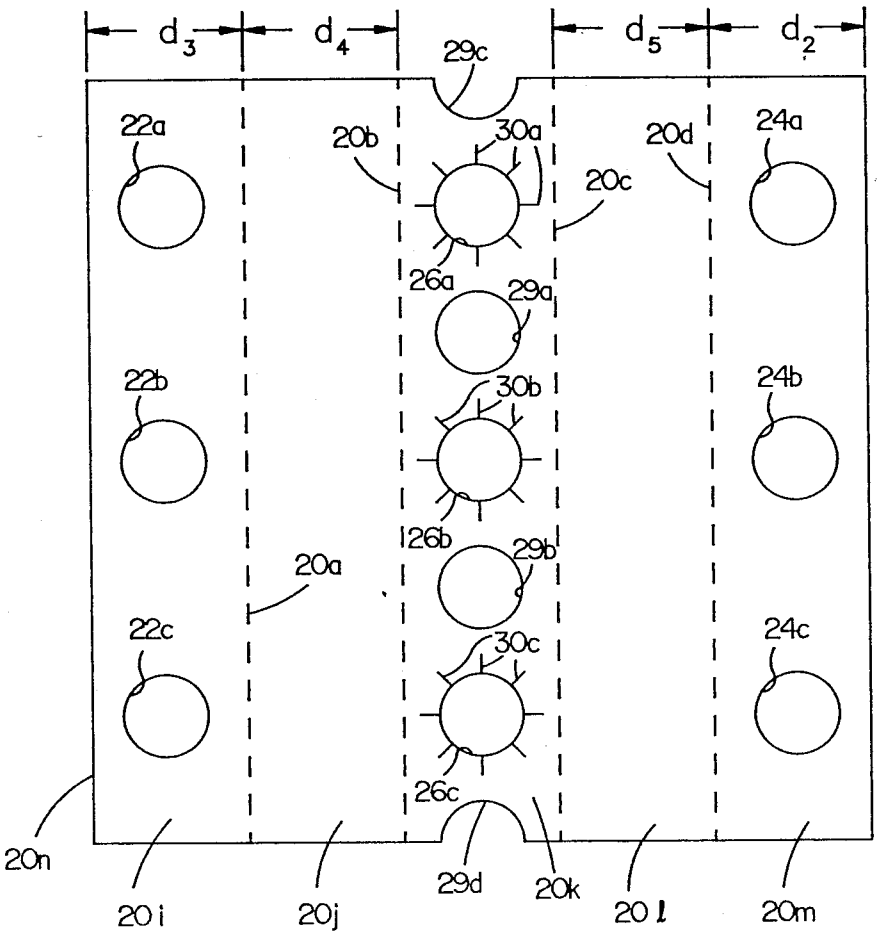
Figure 3B:
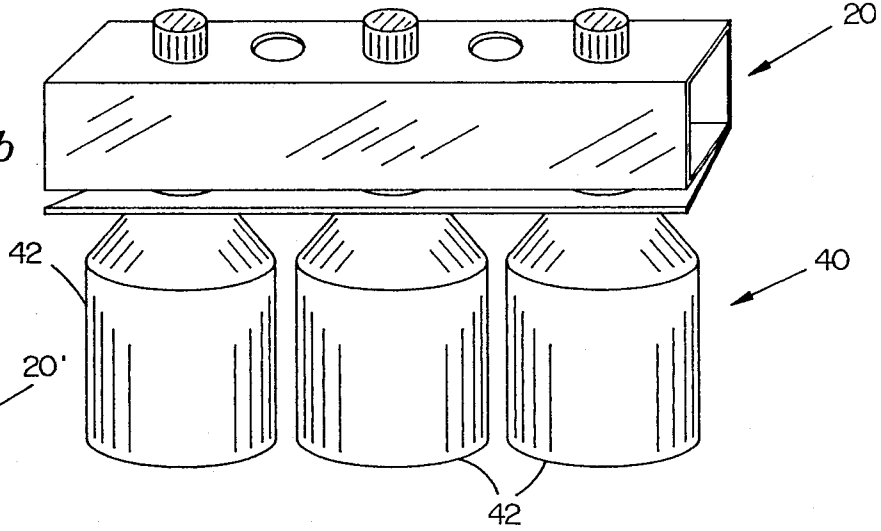
Figure 3C:
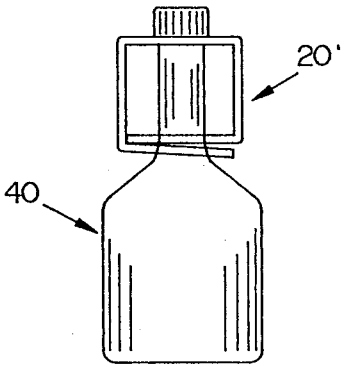

The openings 29*a*–29*b* serve to receive the fingers of a person's hand to facilitate gripping and transportation of the carrier. For example, if the carrier of FIG. 3*a* is reduced to a two container carrier by cutting along line L1, the "half circle" openings 29c and the upper half of 29a serve to receive the fingers of the user's hand.

FIGS. 2a–2c show the carrier 20 fully loaded with six containers. The containers in each linear array LA1, for example (see FIGS. 2b and 2c), are aligned so that the short sides of the center container 42''' engage the adjacent short sides of containers 42'' and 42''''. The containers in linear array LA2 are orientated in a similar fashion. The outer, long sides of each linear array, generally lie in a common plane which planes are substantially parallel to the side panels. The base portions of the containers occupy a volumetric region whose length $L_1$ and width $W_1$ is greater than the length L and width W of carrier 20 (see FIGS. 1 and 2a–2c). As can best be seen from FIG. 2a, the bottom of adjacent long sides of the containers in the linear array LA1 and LA2 are urged into engagement due to the unique arrangement and geometry of the carrier 20 and specifically the openings provided therein for receiving the necks 44 of each container.

Although the carrier embodiment of FIGS. 1a through 2c is designed with the capacity for supporting six containers, it should be understood that the identical results can be obtained with substantially the same carrier design when accommodating pairs of containers such as two, four, six, or eight containers in number, the only difference in these modifications being the length dimension of the carrier and the number of holes provided for the containers. For example, the carrier of FIG. 1a may easily be modified to accommodate four containers simply by reducing the length L of the carrier blank, thus eliminating the holes 22a, 26a, 28a, and 24a. In addition, it is also appropriate and in fact, preferred, to relocate the gripping holes 29a and 29b so that they are centered relative to the carrier geometry. Similarly, to modify the carrier to accommodate eight containers, the carrier length L may be increased to provide another row of holes such as 22a, 26a, 28a and 24a, with appropriate relocation (i.e. centering) of the gripping openings 29a and 29b. The advantages described herein are obtained by any of the above modifications.

The carrier 20, although concealing a portion of the neck of each container, exposes a major portion of the container to full view. Since the base portion of the container is exposed to view, the aesthetically appealing label L2, shown in dotted fashion in FIG. 1c of the container is fully exposed to view enhancing the appearance of the overall assembly to the potential customer. Thus, the carrier need not be provided with printed matter which is the same as that carried by the container and the carrier may carry a totally different message which adds to the message on the container, rather than replacing the message on the container which is required of carriers which substantially enclose and/or envelope the container.

Still another embodiment of the present invention adapted for carrying a single row of containers is shown in FIGS. 3a, 3b, 3c and 3d. The containers 40 shown in FIGS. 3b–3d have cylindrical-shaped base portions 42. If desired, the carrier of FIGS. 3a–3d may accommodate containers of the shape shown in FIGS. 2a–2g. The carrier blank 20' shown in FIG. 3a has a number of physical features similar to that shown in FIG. 1a and as a result, like features have been designated by like numerals in FIGS. 1a and 3a. The major distinction of the embodiment of FIG. 3a is the reduction in width of panel 20k and the elimination of one row of interlocking openings while the remaining row of interlocking openings are aligned with their centers lying along the longitudinal axis of the carrier. The gripping openings 29a and 29b are interspersed between the interlocking openings 26a through 26c as shown.

Figure 3D:
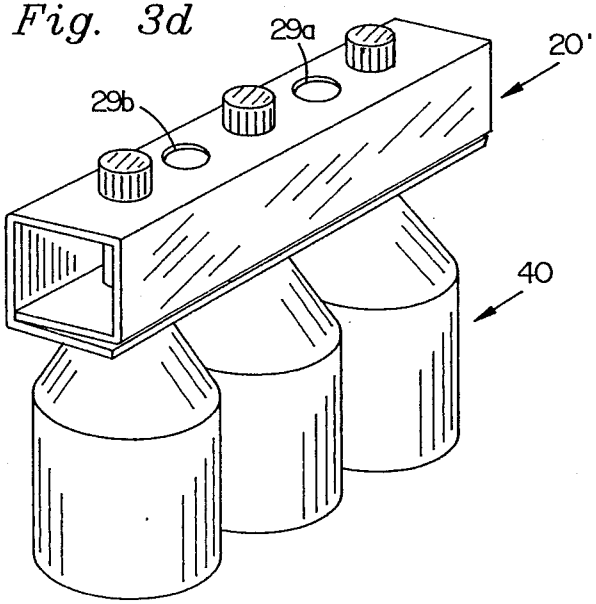

The carton blank 20' is folded along the score lines 20a–20d to form a substantially rectangular shaped tubular configuration, as shown best in FIG. 3d and wherein bottom panel 20m overlies bottom panel 20i. the score line 20d is preferably spaced a greater distance d2 from its adjacent edge 20p than the spacing between score line 20a and its adjacent edge 20n. Also, the distance d5 between score lines 20c and 20d is greater than the distance d4 between score lines 20a and 20b, to assure proper alignment of the openings 22, 24 and 26. The openings 22a–22c and 24a–24c have their centers lying along imaginary lines which each spaced an equal distance inwardly from their adjacent edges 20n and 20p, respectively. In one preferred embodiment, score line 20d is spaced 2 inches from edge 20p, while score line 20a is spaced 1.875 inches from adjacent edge 20n. The openings 22a–22c and 24a–24c preferably have 1.125 inch diameters and have their center lines spaced inwardly one (1) inch from adjacent edges 20n and 20p, respectively.

The carrier embodiment of FIGS. 3a–3d retains the unique advantages of the carrier shown in FIGS. 1a–2c in that the carrier does not dimensionally increase the cubic inch or perimeter boundary of the containers supported by the carrier and can similarly be packed in the same reshipper carton used for bulk distribution, again eliminating the handling of each individual container. The rigidity of the carriers, as well as the stability of the containers supported thereby, is attained by the size of the die cut holes, and the slitted openings 26a–26c serving as the primary load bearing points for the containers. An excellent interference fit between the corrugated sheet and the containers is achieved by judicious selection of the inner diameter of the primary load bearing holes 26a–26c which are of the order of 7–13% and preferably of the order of 9% smaller than the outer diameter of the container neck which it retains. The radially aligned slits 30a–30c contribute to the ease of insertion of the neck portions into openings 26a–26c while permitting the corrugated sheet to lock in the gap G beneath the lip of skirt 46 of the containers to prevent the containers from dropping from the carrier.

The embodiment of FIGS. 3a–3d may be modified in a manner similar to the embodiment of FIGS. 1a–2d in that the carrier may be either shortened or lengthened to accommodate a lesser or greater number of containers arranged in a single row, without relinquishing any of the unique advantages achieved by the desing of the carrier.

Figures 4A, 4B, 4C, 4D, 4E, 4F, 4G:
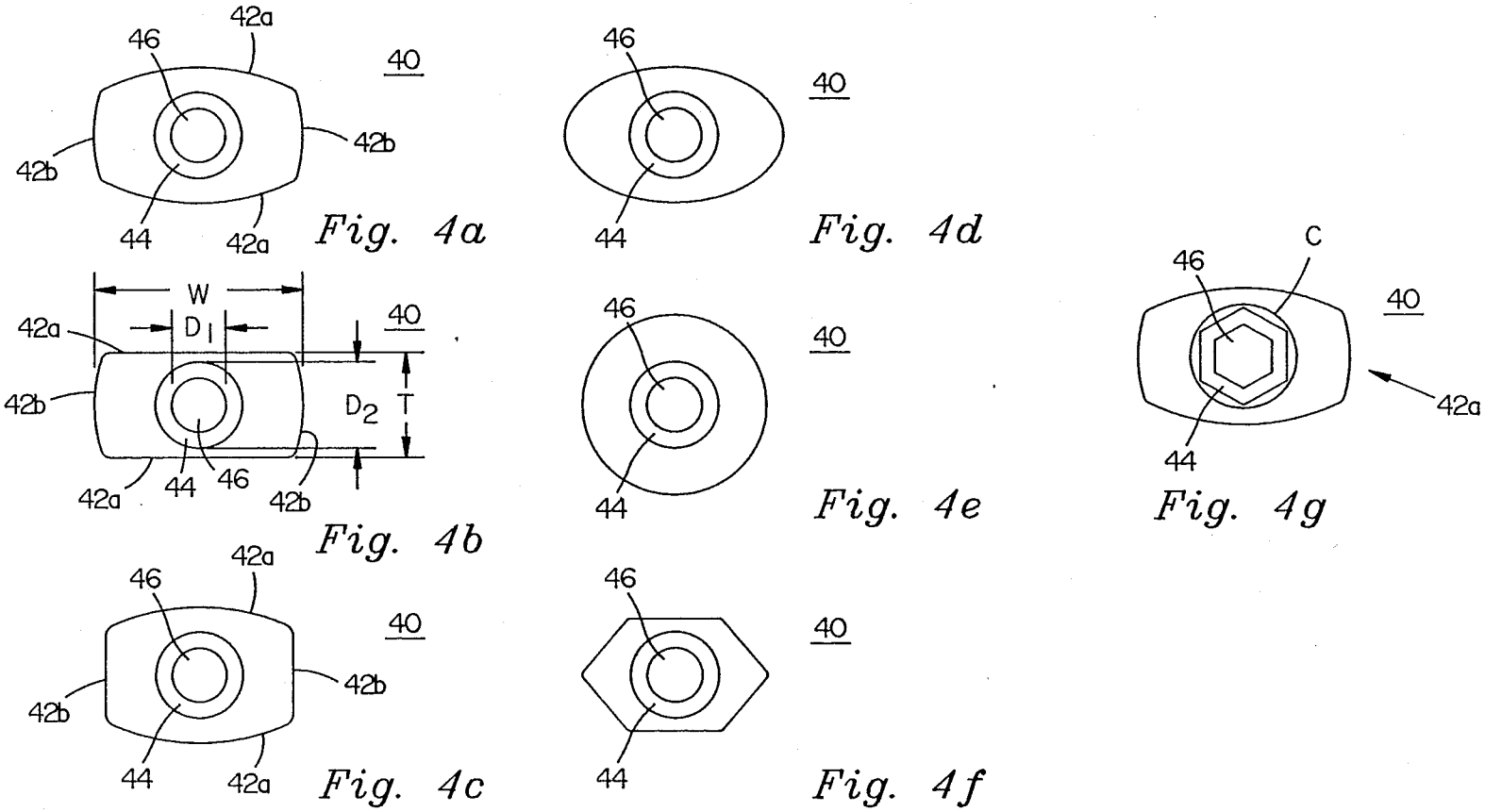

A latitude of modification, change and substitution is intended in the foregoing disclosure, and in some instances, some features of the invention will be employed without a corresponding use of other features. For example, in order to achieve the advantages of the present invention it is not necessary that the containers 40 have a substantially rectangular parallelipiped-shaped base portion 42. The only requirement is that the base portion of the container 40 have mutually perpendicular outer dimensions which are greater than the mutually perpendicular outer dimension of the neck portions. Noting the top plan views of FIGS. 4a–4g, FIG. 4a shows a container 40 having a base portion with convex long sides 42a, 42a and convex short sides 42b, 42b. FIG. 4b shows a container with a base portion having planar long sides 42*a*, 42*a* and convex short sides 42*b*, 42*b*. FIG. 4*c* shows a container with a base portion having convex long sides 42*a*, 42*a* and planar short sides 42*b*, 42*b*. FIG. 4*d* shows a container having a base portion of elliptical shape. FIG. 4*e* shows a container having a base portion with a circular shape. FIG. 4*f* shows a container with a regular polygonal shape (i.e. six sides). Any of the above container configurations may be employed for use with the carrier of the present invention so long as the neck portion mutually perpendicular outer dimensions are less than the mutually perpendicular outer dimensions of the container base portion. As one example, noting FIG. 4*b*, the mutually perpendicular dimensions W and T are both greater than the mutually perpendicular dimensions D1 and D2 of neck portion 4*b*, D1 being equal to D1 since the neck portion has a circular shaped cross-section.

The neck portion is preferably circular in cross-section but may be any regular polygonal shape such as square, pentagonal, hexagonal, octagonal, etc. so long as its outer dimensions, which is the diameter of an imaginary circular circumscribing the polygonal shape is less than the outer dimensions of the container base portion. Note FIG. 4*g* in which the diameter D of an imaginary circle C circumscribing the six-sided neck portion 44 is less than the length L and thickness T of the base portion 42*a*. If desired, the openings in the carrier receiving the neck portions may be polygonal-shaped.

Accordingly, it is appropriate that the appended claims be construed broadly and in a manner consistent with the spirit and scope of the invention herein.

What is claimed is:

1. An assembly comprising a carrier and a plurality of containers, said carrier carrying and supporting a plurality of said containers, each container having a base portion and a narrow neck portion integral with and extending upwardly from the base portion, the outer diameter of said neck portion embraced by said carrier being less than the shorter dimensions of the base portion and having annular groove means, each container having a closure cap releasably secured to the upper open end of said neck portion;

said carrier being formed from a single sheet of a suitable stiff, corrugated cardboard-like material;

said sheet having a substantially rectangular-shaped perimeter and being scored so as to provide a plurality of score lines arranged in spaced parallel fashion and being substantially parallel to one pair of opposite sides of said sheet;

said sheet being bent along said score lines to form a hollow, substantially rectangular-shaped cross-sectional configuration defined by a center panel, two downwardly depending side panels integral with said center panel and two bottom panels each being integral with one of said side panels;

said center panel having a plurality of container supporting openings arranged at spaced intervals to define at least one substantially linear array;

said container supporting openings being spaced inwardly from the score lines defining said center panel and being arranged so that the edge of the opening around substantially the entire periphery thereof extends into said annular groove means substantially without bending, said container supporting openings each yielding only slightly when the cap of the container is pressed into said opening;

at least one of said bottom panels having an array of openings, each opening in the bottom panel being substantially in alignment with one of the openings in said center panel to receive the neck portion of one of said containers;

the neck portion of each container having annular groove means for interengagement with one of the carrier supporting openings in said center panel to secure the container to the carrier;

the center panel of each container having a substantially rectangular configuration;

the containers supported by the carrier occupying a volumetric region having a length dimension and a width dimension perpendicular to the direction of said length dimension;

the outer dimensions of the carrier being such that the length of the carrier is less than the length of said volumetric region, such that the width of the carrier is less than width of said volumetric region and such that the height of the carrier is less than the height of the neck portion of the containers;

said containers being arranged in a single, substantially linear array; and said bottom panels being arranged so that they overlap one another and so that the openings therein substantially coincide whereby the neck portion of each container extends through an associated opening in each of said bottom panels and an associated container supporting opening in said center panel; said carrier cooperating with the container to maintain its folded position without the need for adhesives or locking tabs or other locking elements.

2. An assembly comprising a carrier and a plurality of containers, said carrier carrying and supporting a plurality of said containers, each container having a base portion and a narrow neck portion integral with and extending upwardly from the base portion, the outer diameter of said neck portion embraced by said carrier being less than the shorter dimensions of the base portion, each container having a closure cap releasably secured to the upper open end of said neck portion;

said carrier being formed from a single sheet of a suitable stiff, cardboard-like material;

said sheet having a substantially rectangular-shaped perimeter and being scored so as to provide a plurality of score lines arranged in spaced parallel fashion and being substantially parallel to one pair of opposite sides of said sheet;

said sheet being bent along said score lines to form a hollow, substantially rectangular-shaped cross-sectional configuration defined by a center panel, two downwardly depending side panels integral with said center panel and two bottom panels each being integral with one of said side panels;

said center panel having a plurality of container supporting openings arranged at spaced intervals to define two substantially linear arrays;

at least one of said bottom panels having an array of openings, each opening in the bottom panel being substantially in alignment with one of the openings in said center panel to receive the neck portion of one of said containers;

the neck portion of each container having annular groove means for interengagement with one of the openings in said center panel to secure the container to the carrier;

the center panel of each container having a substantially rectangular configuration;

the containers supported by the carrier occupying a volumetric region having a length dimension and a width dimension perpendicular to the direction of said length dimension;

the outer dimensions of the carrier being such that the length of the carrier is less than the length of said volumetric region, such that the width of the carrier is less than width of said volumetric region and such that the height of the carrier is less than the height of the neck portion of the containers;

said bottom panels being arranged so that their openings each underlie associated openings of one of said linear arrays in said center panel; and the openings in each of said bottom panels being positioned relative to associated openings of the substantially linear arrays in said center panel to displace the container supported therein a slight angle to the vertical and toward the container of the other linear array thereby urging the lower end of each container in a first one of said linear arrays into engagement with the lower end of an associated container in the adjacent array, to thereby prevent the containers from freely swinging during holding and transportation of the carrier.

3. The assembly of claim 2 wherein the openings in said bottom panels are so located in the panels relative to the openings provided in the center panel as to cause the bottom panels to extend upwardly and inwardly from the fold line joining the bottom panels to the side panels whereby the bottom panels cooperatively define an inverted V-shaped configuration.

4. The assembly of claim 1 wherein said center panel is provided with at least two additional openings which preferably lie along an imaginary longitudinal axis of the center panel to facilitate gripping and handling of the carrier.

5. The assembly of claim 1 wherein the container supporting openings in said center panel are of a diameter which is of the order of 8–12% less than the outer diameter of the neck portion of the container surrounded by said opening.

6. The assembly of claim 1 wherein said sheet is formed of a corrugated cardboard material;

the corrugations running in a direction perpendicular to the fold lines.

7. The assembly of claim 5 wherein the openings in said center panel receiving the neck portion of a container are provided with a plurality of radially aligned slits extending outwardly from said openings at substantially equally spaced angular intervals to facilitate insertion of the neck portion of a container into said openings.

8. The assembly of claim 1 wherein each container neck portion is provided with a threaded portion immediately adjacent the open upper end thereof;

each closure cap having a threaded portion cooperating with the threaded portion of said neck portion for releasably securing the closure cap upon its container.

9. The assembly of claim 1 wherein said closure cap is comprised of a substantially cylindrical skirt portion;

the neck portion being provided with an annular shoulder arranged a closely spaced distance from the free edge of the closure cap skirt portion when the closure cap is secured upon said container neck portion to thereby define an annular gap which comprises the annular groove means forming an interference fit with a carrier supporting opening provided in the center panel of said carrier.

10. The assembly of claim 1 wherein said annular groove means is arranged a spaced distance below the container closure cap for cooperation with an opening in the center panel to provide an interlocking arrangement therebetween.

11. The assembly of claim 1 wherein the carrier supports a minimum of 2 containers.

12. The assembly of claim 11 wherein the two containers supported by the carrier are arranged so that adjacent surfaces of the base portion of said containers are in engagement.

13. The assembly of claim 11 the base portion of each container has a pair of opposite long sides and a pair of opposite short sides, wherein one adjacent short side of the containers are in engagement.

14. The assembly of claim 11 wherein said carrier is provided with openings in said center and bottom panels sufficient to support six containers, the openings in said center panel being arranged in two linear arrays of three openings in each array, whereby said containers are arranged in two separate rows of three containers each.

15. The assembly of claim 14 wherein the base portion of each container comprises a pair of opposing long sides and a pair of opposing short sides whereby one long side of each of the three containers in one of said rows is in engagement with one long side of an associated container in the remaining row.

16. The assembly of claim 1 wherein said carrier is provided with openings in said center and bottom panels sufficient to support four containers, said openings being arranged in two arrays each having two openings whereby said containers arranged in two separate rows of two containers each.

17. The assembly of claim 1 wherein the base portion of each container comprises a pair of opposing long sides and a pair of opposing short sides whereby one long side of the two containers in one of said arrays is in engagement with one long side of an associated container in the remaining array.

18. The assembly of claim 1 wherein the center panel and the bottom panels of said container are provided with openings arranged to support a single row of containers;

the score line defining the fold between one of the bottom panels and its adjacent side panel being a greater distance from the free edge of the adjacent bottom panel than the score line defining the fold between the remaining bottom panel and its adjacent side panel.

19. The assembly of claim 18 wherein the openings in said bottom panels are of a diameter sufficient to facilitate the insertion of the neck portion of a container in an associated container supporting opening in the center panel to facilitate creation of a satisfactory interference fit between the groove means in the neck portion and the opening in the center panel fitted within said groove means.

20. The assembly of claim 2 wherein the openings in said bottom panels are sufficiently larger than the outer diameter of the neck portions disposed in said openings when the containers are properly mounted within the carrier to enable said bottom panels to achieve the aforesaid inverted V-shaped orientation.

21. The assembly of claim 2 wherein the diameter of the opening in said bottom panels is greater than the diameter of the openings in said center panel.

22. The assembly of claim 18 wherein the side panel joined to said one of said bottom panels is greater in height than the side panel joined to said remainig bottom panel.

* * * * *